US006891480B2

(12) United States Patent
Williams et al.

(10) Patent No.: US 6,891,480 B2
(45) Date of Patent: May 10, 2005

(54) SELF-ALIGNING SAFETY SENSORS

(75) Inventors: Gerald H. Williams, West Branch, MI (US); Robert Schram, Becansfield (CA)

(73) Assignee: Lynx Industries, Inc., Archbold, OH (US)

( * ) Notice: Subject to any disclaimer, the term of this patent is extended or adjusted under 35 U.S.C. 154(b) by 824 days.

(21) Appl. No.: 09/773,129

(22) Filed: Jan. 31, 2001

(65) Prior Publication Data

US 2002/0105430 A1 Aug. 8, 2002

(51) Int. Cl.[7] ..... G08B 23/00

(52) U.S. Cl. ..... 340/693.6; 340/693.9; 340/556; 361/600

(58) Field of Search ..... 340/693.5, 693.6, 340/693.4, 545.1, 545.2, 556, 557; 361/600

(56) References Cited

U.S. PATENT DOCUMENTS 4,059,832 A * 11/1977 Conklin ..... 340/546
4,593,491 A * 6/1986 Carlson et al. ..... 49/13
4,882,563 A * 11/1989 Perlman et al. ..... 340/426.29
5,166,662 A * 11/1992 Santagato ..... 340/426.29
5,341,123 A * 8/1994 Schuman et al. ..... 340/546
5,499,013 A * 3/1996 Konotchick ..... 340/539.22
5,518,350 A * 5/1996 Kyprios ..... 411/343
5,577,800 A * 11/1996 Earl, Jr. ..... 297/195.11
5,738,323 A 4/1998 Ibarra
5,934,019 A * 8/1999 Rotharmel et al. ..... 49/28
6,002,333 A * 12/1999 Hickey ..... 340/550
6,176,039 B1 * 1/2001 Craig ..... 49/26

* cited by examiner

*Primary Examiner*—Benjamin C. Lee
(74) *Attorney, Agent, or Firm*—McDonnell Boehnen Hulbert & Berghoff LLP

(57) ABSTRACT

A self-aligning sensor assembly that is useful for mounting safety sensors that require precise alignment such as electric eyes and electric garage door opener sensors that include an aligned emitter and detector wherein the self-aligning mechanism allows the sensors to be realigned manually or automatically. This invention is also a method for deactivating a sensor mechanism such as a garage door opener sensor using the self-aligning mechanism of this invention.

19 Claims, 9 Drawing Sheets

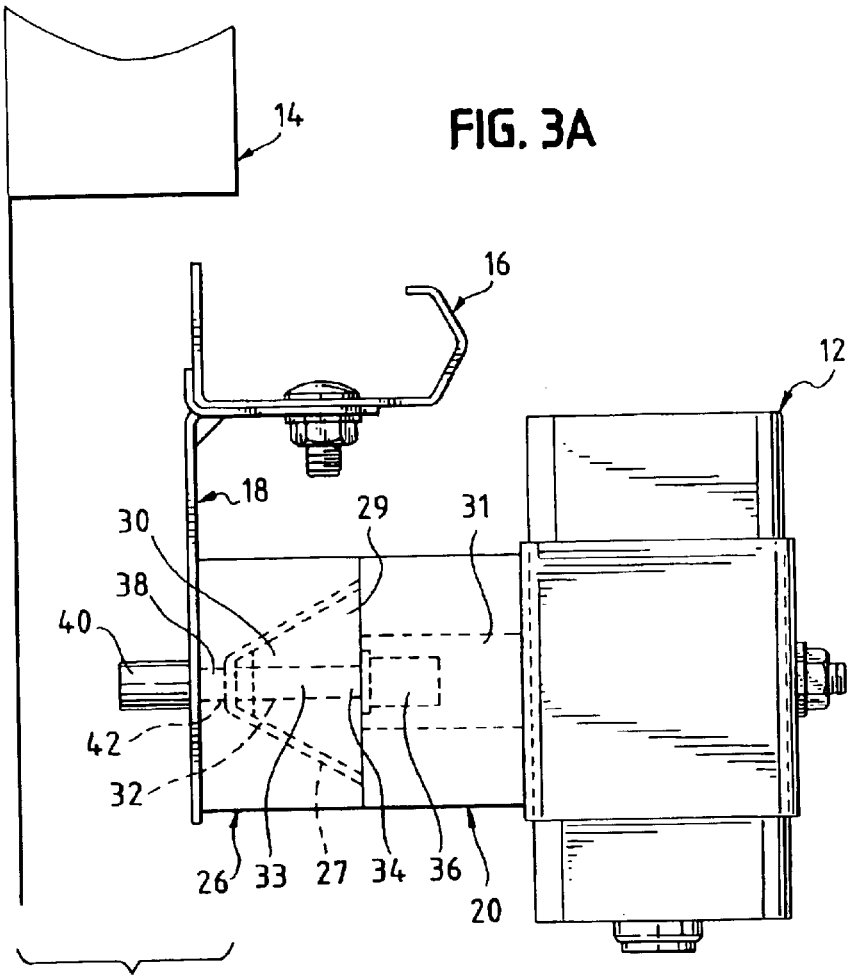
FIG. 3A
FIG. 3B
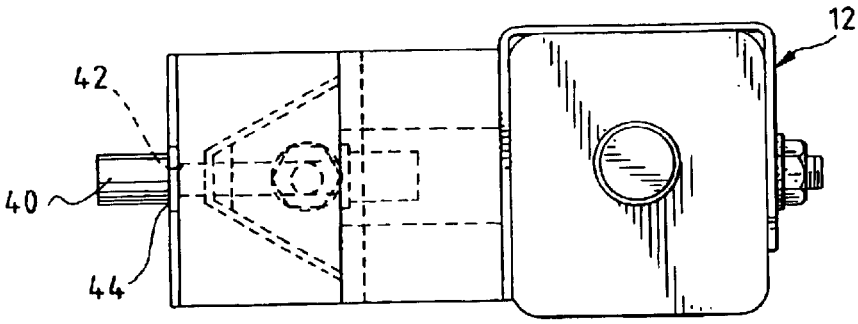

SELF-ALIGNING SAFETY SENSORS

BACKGROUND OF THE INVENTION (1) Field of the Invention

This invention concerns a self-aligning bracket assembly that is useful for mounting safety sensors that require precise alignment such as electric eyes wherein the self-aligning mechanism allows the sensors to be easily realigned. This invention is also a method for deactivating and then reactivating a sensor mechanism such as a garage door opener sensor using the self-aligning mechanism of this invention.

(2) Description of the Art

There are many different devices and systems that use sensors such as photoelectric sensors and radio frequency sensors that operate on a line of sight principal to detect when someone or something has broken a beam. For example, many stores have photoelectric sensors that detect when someone has entered the store and then activate a bell. One area where photoelectric sensors are required are in conjunction electric garage door openers. Photoelectric garage door sensors are located close to the ground and cause the garage door opener to cease closing and to return to the open position when the sensor beam is interrupted. This prevents animals, children, and humans from being injured by closing garage doors and it also prevents closing garage doors from damaging automobiles and other personal property.

In a garage door opener application, photoelectric sensors are rigidly attached to a wall or to some other stationary surface and orientated so that the sending sensor (the emitter) and the receiving sensor (the detector) are aligned. When alignment is lost, the sensors do not work. In the case of garage door openers, when the sensors go out of alignment, the garage door opener will open, but it will not close.

Since the garage door opener sensors are located close to the ground, they are prone to be banged by bicycles, automobiles, children and by various other items that can cause the garage door opener sensors to go out of alignment. When this happens, consumers typically must call a service technician who must realign the garage door opener sensors. The service visits are costly to the consumer and are time consuming to the service provider.

Because photoelectric sensors are easy to knock out of alignment and because their realignment is costly and time consuming, there is a need for a sensor assembly that is easily realigned when the sensor is banged or jarred out of alignment. In addition, there is a need for a sensor mechanism that can be purposely adjusted to bring the sensors out of alignment so that, for instance, a garage door cannot be accidentally closed.

SUMMARY OF THE INVENTION

It is an object of this invention to provide a sensor bracket assembly that is self aligning.

It is another object of this invention to provide a sensor bracket assembly that can be aligned by a consumer without the aid of a technician.

It is yet another object of this invention to provide a sensor bracket assembly that allows for purposeful de-alignment of the sensor to prevent a garage door from closing.

In one embodiment, this invention includes a self-aligning sensor assembly. The self-aligning sensor assembly includes a first bracket having a female portion, a second bracket having a male portion that is complementary to the first bracket female portion, a flexible assembly attached to the first bracket and attached to the second bracket, and a sensor attached to a bracket selected from the first bracket or the second bracket.

In another embodiment, this invention includes a self-aligning sensor assembly useful in conjunction with an electric garage door opener. The assembly includes a first bracket including a female portion in the shape of a truncated pyramid, a second bracket including a male portion that is complementary to the first bracket female portion, a flexible assembly attached to the first bracket and attached to the second bracket wherein the flexible assembly includes a flexible link, and an electric garage door opener sensor attached to a bracket selected from the first bracket or the second bracket.

In still another embodiment, this invention includes a self-aligning sensor assembly including a spring having a first end attached to a base and a second end. A sensor bracket is attached to the spring second end and a sensor is attached to the sensor bracket.

In yet another embodiment, this invention includes a method for deactivating an electric garage door opener using a self-aligning sensor assembly including a stationary first bracket including a portion selected from a male portion and a female portion, a second bracket including a portion selected from a male portion or a female portion wherein the first bracket and the second bracket do not both include male portions or female portions and wherein the female portion is complementary to the male portion, a flexible assembly attached to the first bracket and attached to the second bracket for uniting the first bracket with the second bracket under tension, and a first sensor attached to the second bracket and aligned with a second electric garage door opener sensor. The method includes grasping the second bracket and pulling the second bracket laterally away from the stationary first bracket until the male and female portions disengage, and rotating the second bracket in a first direction until the sending sensor and the receiving to go out of alignment.

DESCRIPTION OF THE FIGURES

FIGS. 3A and 3B are top and side views of a self-aligning sensor assembly of this invention;

DESCRIPTION OF THE CURRENT EMBODIMENT

This invention concerns a self-aligning sensor assembly that is useful for mounting safety sensors that require precise alignment such as electric eyes that have an aligned transmitter and receiver wherein the self-aligning sensor assembly allows for convenient and easy realignment of sensors that go out of alignment. This invention is also a method for deactivating a sensor mechanism such as a garage door opener sensor using self-aligning sensor assemblies of this invention.

The self-aligning sensor assemblies of this invention are useful in conjunction with any type of sensors that include a mounted transmitter and a separately mounted receiver where alignment of the transmitter sensor and receiver sensor is important for sensor operation. One type of sensor that is particularly useful in conjunction with self-aligning sensor assemblies of this invention are garage door photoelectric sensors. Garage door photoelectric sensors typically include a sensor transmitter that transmits a visible or infrared beam and a sensor receiver that detects the presence of the transmitted beam and that halts or reverses the closing operation of a garage door when the light beam is interrupted. These sensors typically work on a line of sight principal. If the beam is interrupted or if the sensor goes out of alignment such that the beam from the transmitter is not received by the receiver, the sensors cause the electric garage door opener to keep the garage door in the open position.

The self-aligning sensor assembly of this invention will be described with reference to its use in conjunction with garage door opener sensors. However, the description below is not intended in any way to limit the scope or potential applications for the self-aligning sensor assemblies of this invention.

Figure 1:
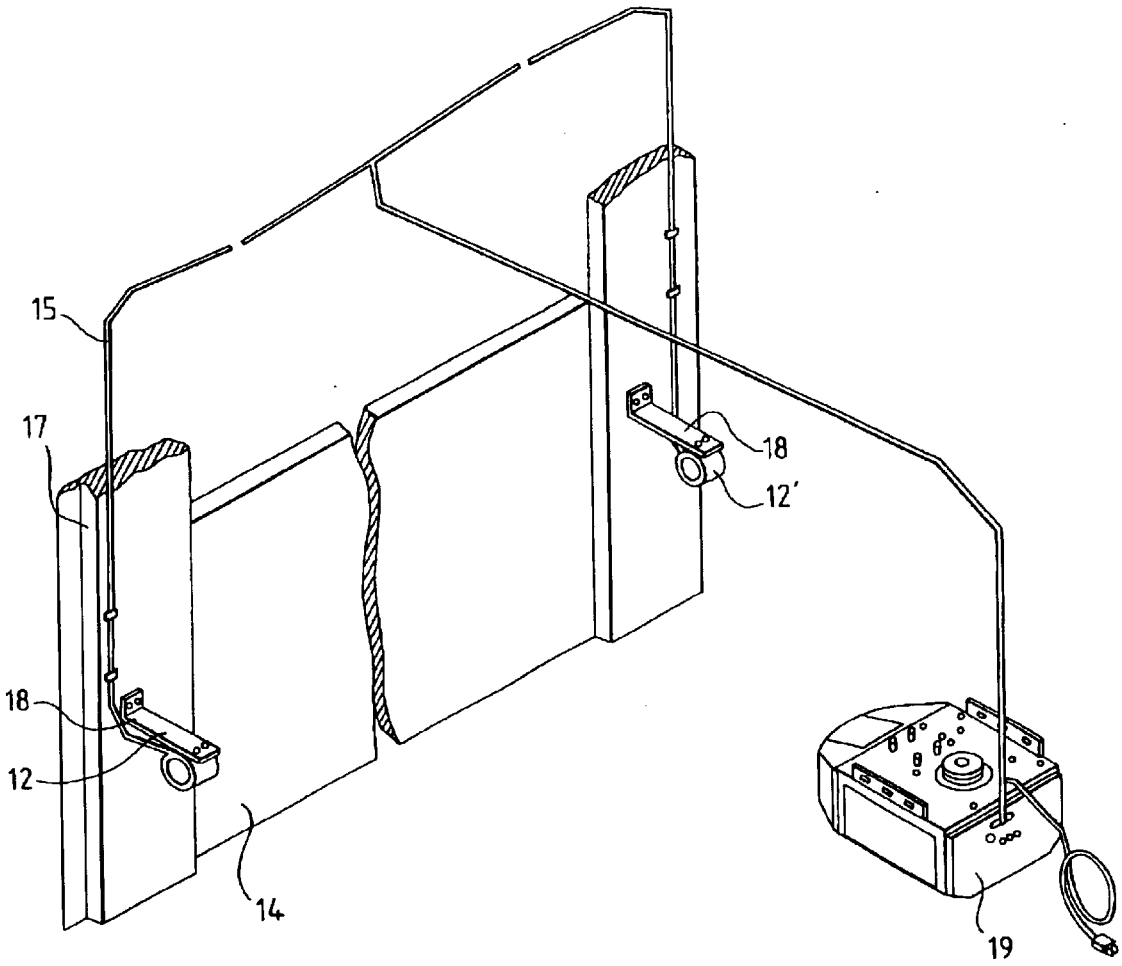
FIG. 1 is a schematic of an electrical garage door opener of the prior art.

A prior art electrical garage door opener system is shown in FIG. 1. According to FIG. 1, the electrical garage door opener system includes two sensors 12 and 12' that oppose one another and that are aligned to allow a continuous beam transmitted by emitter sensor 12 to be continuously received by detector sensor 12'. Sensors 12 and 12' are attached to garage door wall 17 by a rigid bracket 18. Sensors 12 and 12' are also electrically connected by wire 15 to a receiver unit 19 which is capable of opening and closing garage door 14. Interrupting the beam passing between sensors 12 and 12' causes receiver 19 to reverse the closing of garage door 14 or it prevents receiver 19 from closing garage door 14.

Figure 2:
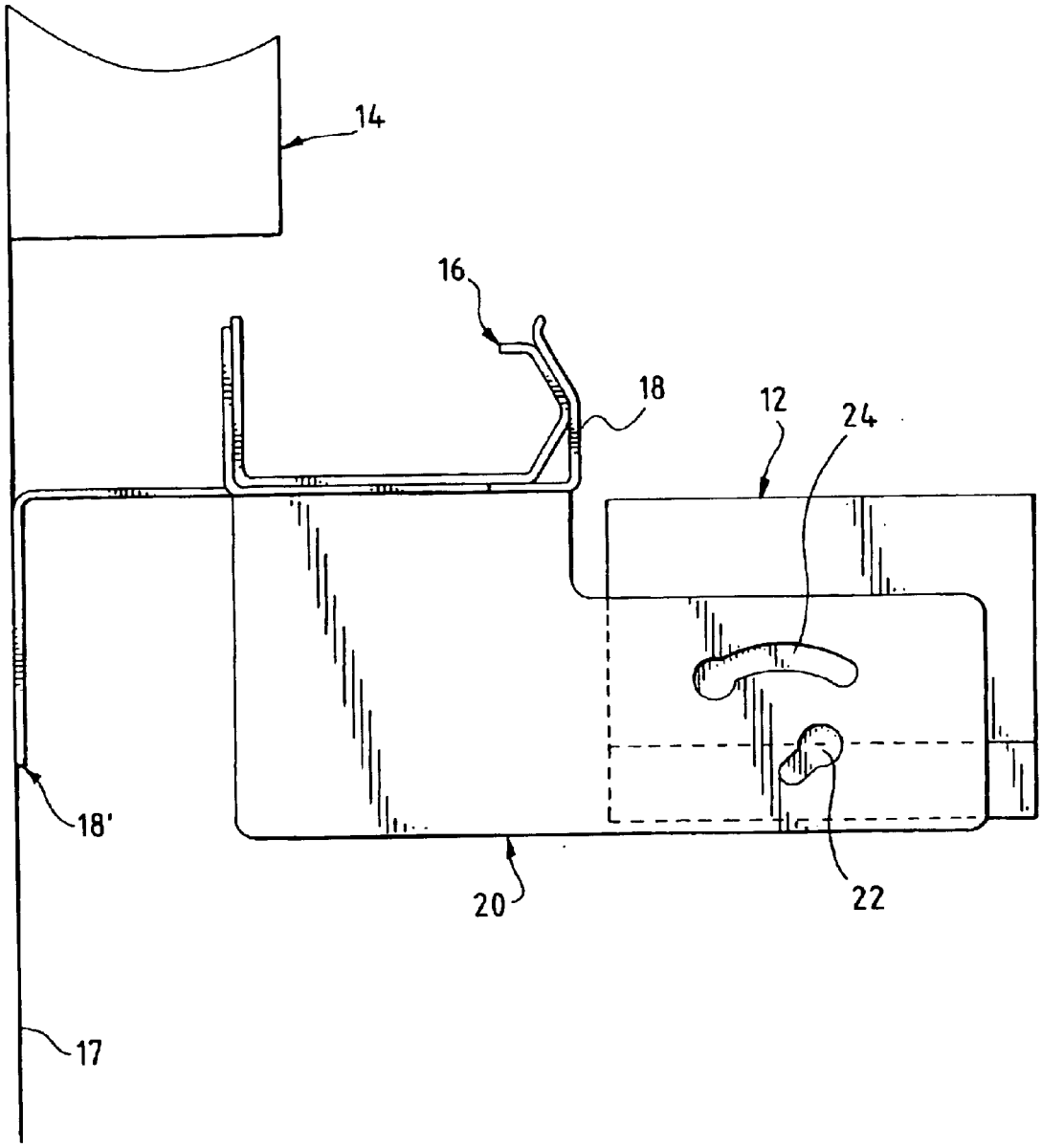
FIG. 2 is a sensor assembly of the prior art.

FIG. 2 is an overhead view of prior art sensor bracket assembly. Typically, a prior art sensor bracket assembly includes a rigid bracket 18 that is attached to stationary garage door track 16 or to a rigid bracket 18 that is rigidly attached to garage door wall 17. Rigid bracket 18 is attached to sensor bracket 20 which is perpendicularly orientated with respect to rigid bracket 18. Sensor bracket 20 includes a first aperture 22 and an adjustment aperture 24. Screws typically are passed through first aperture 22 and adjustment aperture 24 into sensor 12. Adjustment aperture 24 is used to fine tune the alignment of sensor 12 with its opposing sensor on the opposite side of the garage. The bracket shown in FIG. 2 which includes a rigid bracket 18 and a sensor bracket 20 that may be a one piece or a two piece bracket.

Figure 4A:
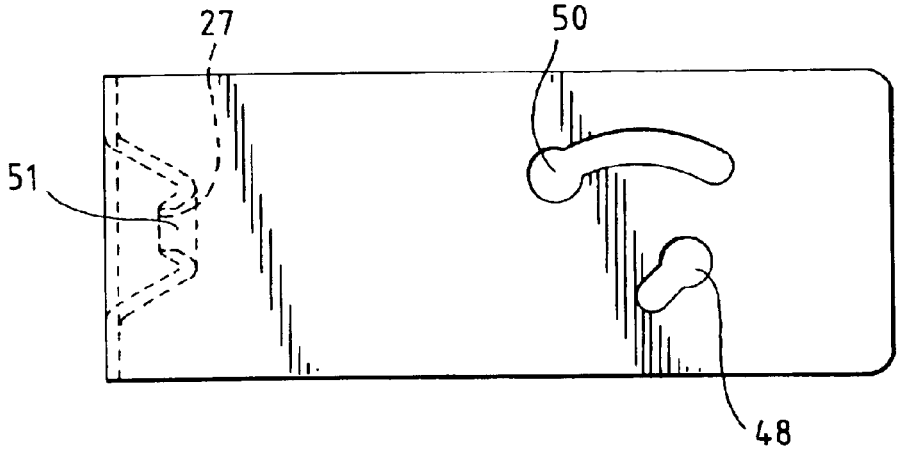
FIGS. 4A, 4B, and 4C are top, side, and end views of a bracket useful in a self-aligning sensor assembly.
Figure 4B:
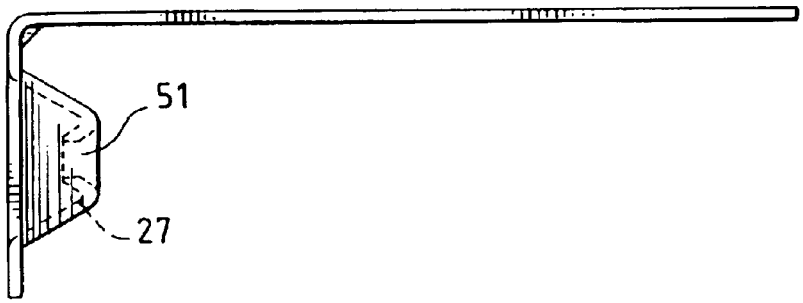
Figure 4C:
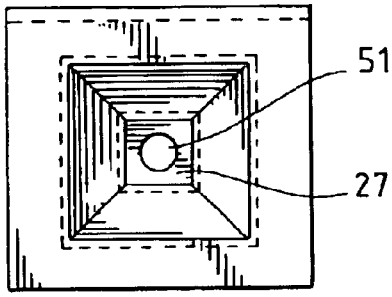
Figure 5B:
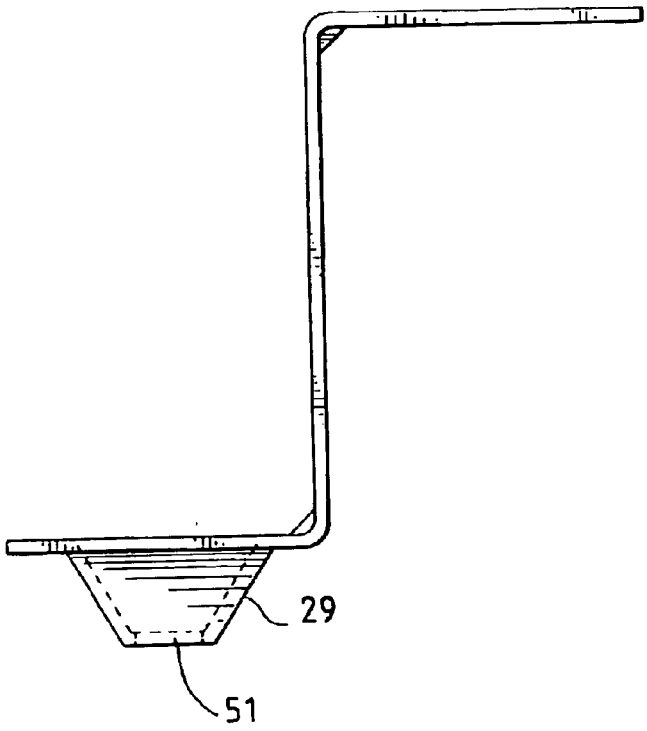
FIGS. 5A and 5B are to and side views respectively of the stationary portion of a bracket useful in a self-aligning sensor assembly of this invention.
Figure 5A:
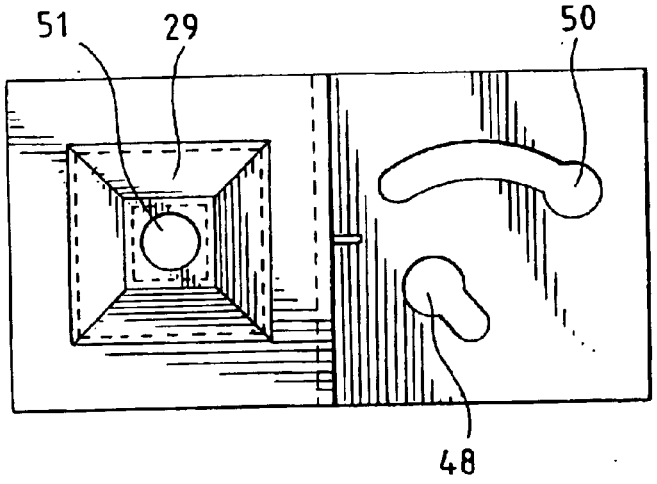

The remaining application Figures are drawn to various, non-limiting embodiments of self-aligning sensor assemblies of this invention. FIGS. 3A and 3B are top and side views of a fully assembled self-aligning sensor assembly of this invention that is associated with a sensor 12. FIGS. 4A, 4B, and 4C are views of a sensor bracket portion of the self-aligning sensor assembly of this invention and FIGS. 5A and 5B are top and side views of a rigid bracket of a self-aligning sensor assembly of this invention. FIGS. 8A, 8B, 8C, 9A, 9B and 9C are top front and end views of several alternative embodiments of self-aligning sensor assemblies of this invention.

FIGS. 3A and 3B depict an embodiment of a self-aligning sensor assembly of this invention. The self-aligning sensor assembly 10 includes a rigid bracket 18 including a first block 26 having a female portion 27. A sensor 12 is associated with sensor bracket 20 which is in the form of a block that has a male portion 29. First block 26 includes a central aperture 30 and second block 20 includes a central aperture 31. A flexible assembly 32 is located in central aperture 30 and central aperture 31 and flexibly unites first block 26 with second block 20. Flexible assembly 32 includes a flexible link 33 in the form of a bungee cord that has a first end 34 that is associated with a first stop 36. Flexible link 33 further includes a second end 38 associated with a second stop 40. First stop 36 and second stop 40 may be associated with first end 34 and second end 38 by any manner known in the art. For example, first end 34 and second end 38 may be adhesively attached to flexible link 32, they may be attached using a set screw, they may be chemically welded, they may be crimped to flexible cable 32, or they may be attached by any other method or apparatus known in the art for reversibly or irreversibly associating flexible link 33 with a base or with a stationary object such as a bracket. The combination of flexible link 33, first stop 36 and second stop 40 forms flexible assembly 32. The purpose of the flexible assembly 32 is to flexibly unite the first block 26 with second block 20 under tension.

Flexible assembly 32 may be united with first block 26 and second block 20 in any manner which urges and hold sensor bracket block 20 against first block 26. In a preferred embodiment shown in FIGS. 3A and 3B, central aperture 30 of second block 20 includes an opening 42 that is smaller in diameter than shoulder 44 of second stop 40 thereby preventing second stop 40 from passing through central aperture 31. In addition, central aperture 30 is sized such that first stop 36 is larger than central aperture 30 thereby causing first stop 36 to be held against outer surface 46 of first block 26. An important feature of the self-aligning sensor assembly is that flexible link 33 is held under tension between first stop 36 and second stop 40. The tension provided by flexible link 33 urges first stop 36 and second stop 40 towards each other thereby urging first block 26 against second block 20 to maintain sensor 12 in a stable unmoving position.

Figure 8A:
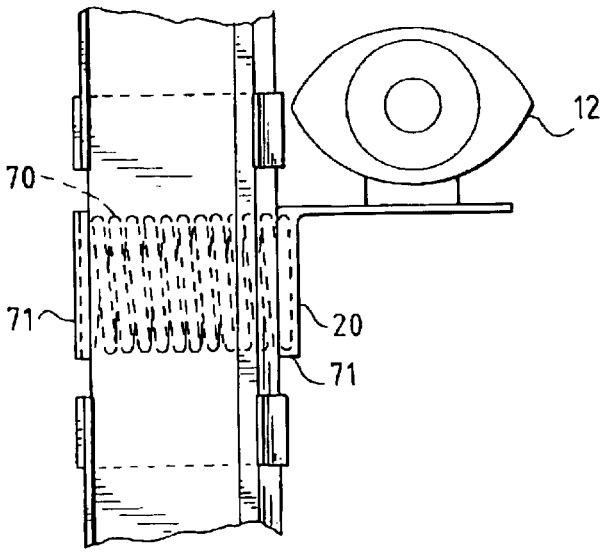
FIGS. 8A, 8B and 8C are side, front and top views respectively of a self-aligning sensor assembly of this invention.
Figure 8B:
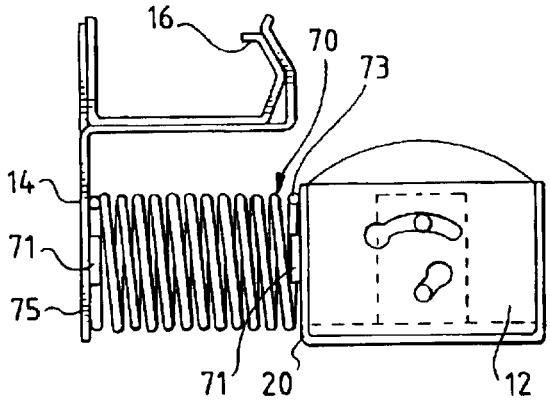
Figure 8C:
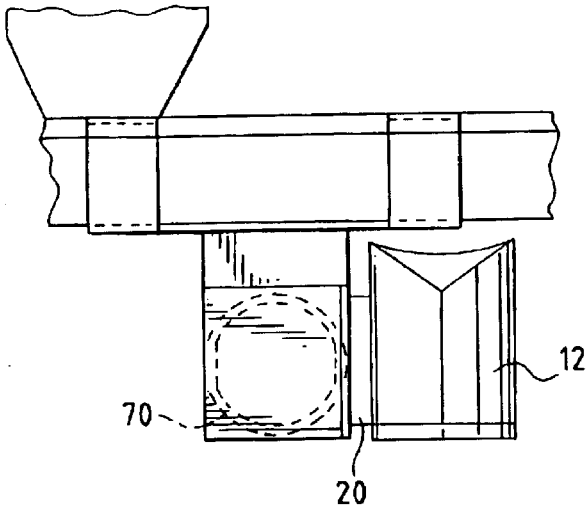

In operation, flexible assembly 32 retains first block 26 motionless against second block 20. If sensor 12 or second block 20 is jarred, flexible assembly 32 flexes to allow second block 20 to move in relationship to first block 26. After being jarred, the sensor is realigned by flexible assembly 32 which draws male portion 29 of second block 20 towards female portion 27 of first block 26 thereby realigning sensor 12 in the precise position that it was in before being jarred. Rigid bracket 18 and first block 20 do not need to be in block form or associated with a block as shown in FIGS. 3A and 3B. Instead, rigid bracket 18 and first block 20 may be manufactured as a flattened material such as a piece of flat metal or plastic or the bracket may be a combination of a flattened material and a block material. Alternatively, one of the brackets may be replaced by a rigid spring as shown in FIGS. 8A–8C. Examples of useful rigid brackets 18 and sensor brackets 20 are shown in FIGS. 4A–4C and 5A–5B. The brackets shown in FIGS. 4A–4C and 5A–5B may be used either as rigid bracket 18 or as a sensor bracket 20. For purposes of this invention, the shape of the bracket is unimportant as is whether the female or male portion is located on a rigid bracket or on a sensor bracket. What is important is that at least one bracket includes a female portion 27 and that the complimentary bracket includes a male portion 29. The brackets shown in FIGS. 4 and 5 further include a first aperture 48 and a second aperture 50. First aperture 48 and second aperture 50 are sized to fit a screw or some other attaching device attaches the bracket either to a sensor 12 or to a garage door track 16 or wall 17. Second aperture 50 is a slotted aperture that allows the bracket to be adjusted in one plane thereby allowing the installer to align the transmitting and receiving sensors 12 and 12'. Once the sensors are aligned, the screw or other attaching device is securely attached to the sensor or to the garage door wall or garage door track to prevent further movement of sensor 12. The brackets shown in FIGS. 4 and 5 also include aperture 51 associated with the male or female bracket portion. Aperture 51 should be of a size sufficient to allow a portion of flexible assembly 32 to pass through aperture 51 in order to apply tension to flexible assembly 32.

Figure 6A:
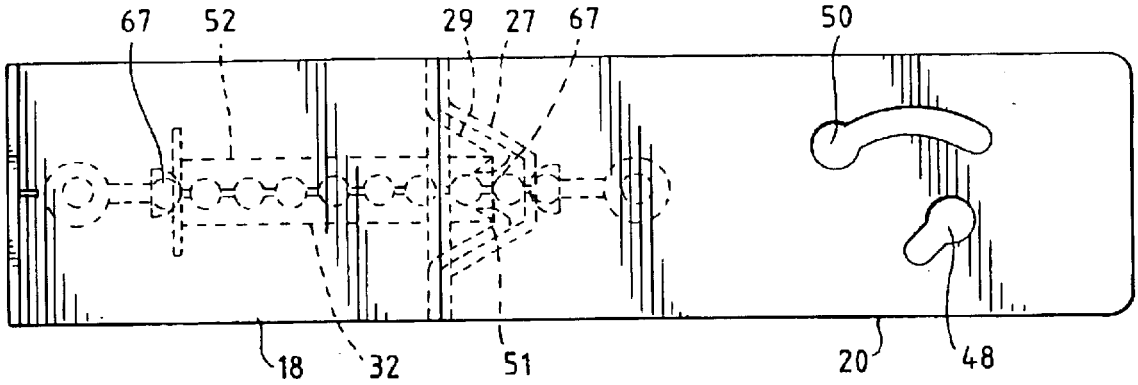
FIGS. 6A, 6B, and 6C are top, side and end views of a self-aligning sensor assembly of this invention.
Figure 6B:
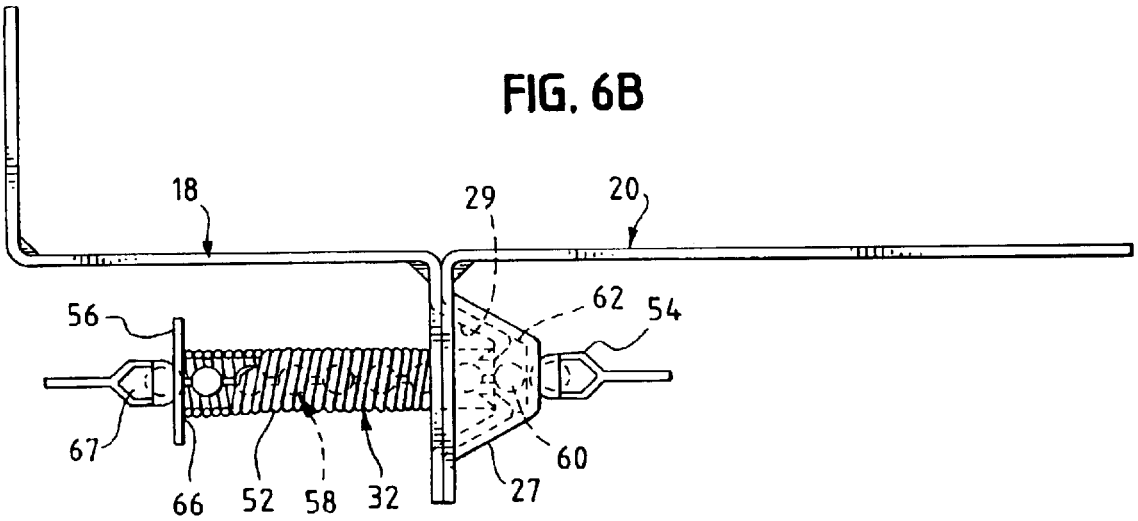
Figure 6C:
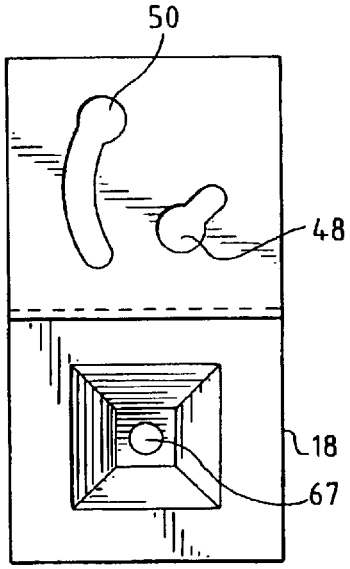

FIGS. 6A, 6B and 6C show various views of a rigid bracket 18 and sensor bracket 20 flexibly united with flexible assembly 49. The flexible assembly embodiment 32 depicted in FIGS. 6A–6C differ from the flexible assembly shown in FIG. 3. The selection of the flexible assembly used to flexibly unite rigid bracket 18 with sensor bracket 20 is not crucial to the invention. A flexible assembly will include a flexible link such as a spring or rubber cord or band that is attached to brackets under tension, or any other flexible structure known in the art for providing tension and that urges the brackets or members into contact with one another.

Flexible assembly 32 shown in FIG. 6 includes a spring 52 that is located between first stop 54 and second stop 56. A chain 58 passes through the center of spring 52. A first end 60 of chain 58 is attached to first stop 54 while a second end 67 of chain 58 is attached to second stop 56. A device other than a chain may be used to unite first stop 54 and second stop 56. For example, a metal wire or a rubber band or elastic cord may be used in lieu of a chain. In order to unite rigid bracket 18 with sensor bracket 20, the chain first end 60 is placed against the inside surface 62 of male portion 29. In a preferred embodiment, male portion 29 includes fingers or an annular groove 51 that prevents spring 52 from moving towards male portion 29. Controlled tension is applied to spring 52 by passing chain 58 through the center of spring 52 until second stop 56 abuts second end 66 of spring 52. Chain 58 then passes through a first aperture 67 associated with male portion 29 and with male portion 29. The chain end that passes through male portion 29 is pulled, causing second stop 56 to move towards male portion 29 thereby applying controlled tension to spring 52. When the desired tension is achieved, the end of chain 58 passing through male portion 29 is associated with first stop 56 which prevents chain 58 from passing through the aperture 67 thereby maintaining constant tension on spring 52. The tension applied to spring 52 flexibly unites rigid bracket 18 and sensor bracket 20 to become flexibly united with one another.

Under normal use, flexible assembly 32 draws male portion 29 and female portion 27 together thereby preventing movement of the sensor bracket assembly. However, if the sensor assembly is inadvertently jarred or bumped, spring 52 which is not completely expanded, allows for some movement of sensor bracket 20 in relation to rigid bracket 18 which remains stationary. The shape and configuration of female portion 27 and male portion 29 can be designed to cause the sensor bracket to reseat and automatically realign itself after being jarred or moved. In some instances, female portion 27 and male portion 29 may not reseat or fully unite with one another after the assembly is jarred. All that needs to be done to reunite or seat the male and female portions is to manually pull or manipulate sensor bracket 20 until female portion 27 is reseated in male portion 29 or vice versa.

FIGS. 8A–8C depict yet another embodiment of a self-aligning sensor assembly of this invention wherein fixed bracket 18 consists of a spring 70 having a first end 75 that is attached to garage door wall 14, garage door rail 16 or to a stationary bracket and a second end 73 that is attached to sensor bracket 20. Spring 70 must be rigid enough to hold sensor 12 and sensor bracket 20 in a stationary and aligned position. Spring 70 should also be resilient enough to provide some give when sensor 12 is jarred. In FIGS. 8A–8C, spring 70 is attached to garage door wall 14 and to sensor bracket 20 by threading the flat ends of spring 70 through guide 71.

Figure 9A:
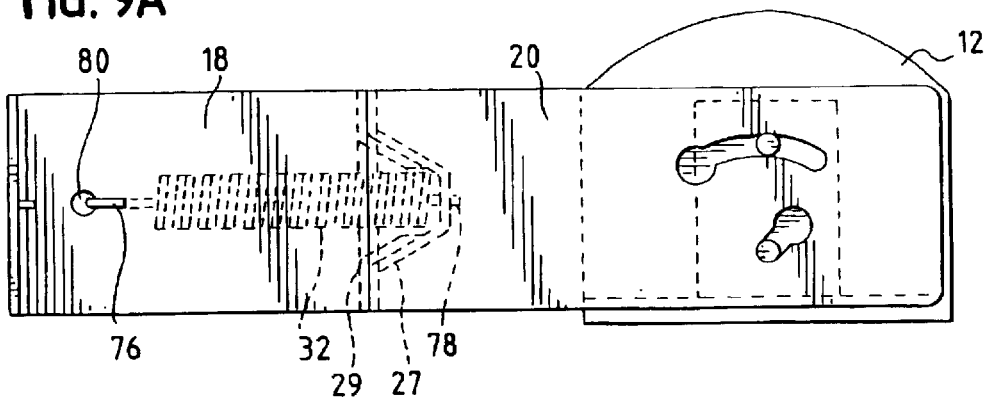
FIGS. 9A, 9B and 9C are top, front and end views respectively of a self-aligning sensor assembly of this invention.
Figure 9B:
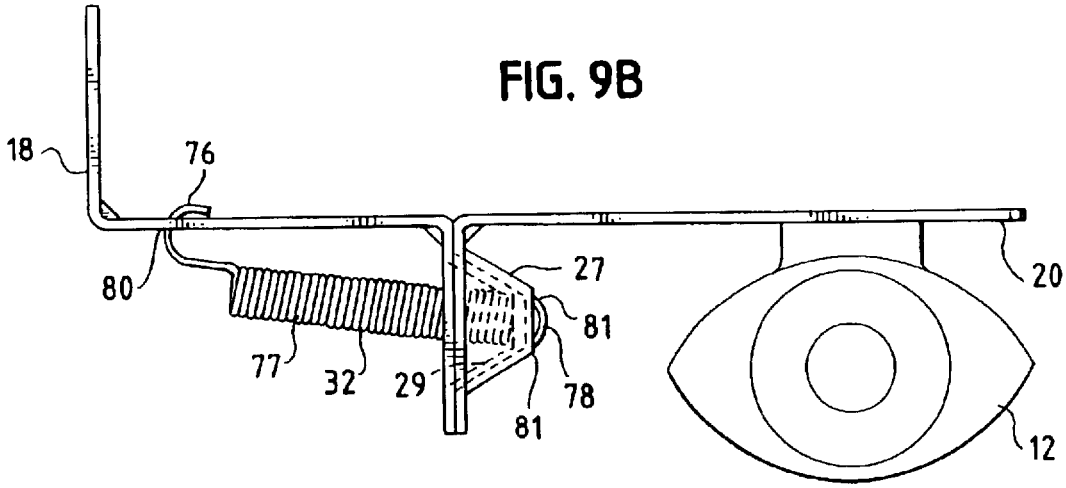
Figure 9C:
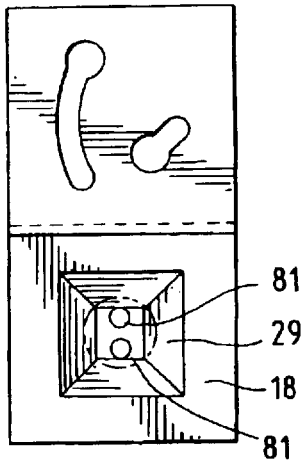

FIGS. 9A–9C depict another alternative embodiment of a self-aligning sensor assembly of this invention. In FIGS. 9A–9C, flexible assembly 32 consists of a spring 77 including a first hooked end 76 and a second hooked end 78. First hooked end 76 is located through hole 80 in bracket 18 while second hooked end 78 is located in apertures 81 in the female or male portion of sensor bracket 20. Spring 77 should be of a length that is short enough to cause tension to be applied to spring 77 when the spring is associated with bracket 18 and with sensor bracket 20.

FIGS. 7A–7F show some of the embodiments of female portions 27 and male portions 29 that can be used in the present invention. FIGS. 7A–F are not exhaustive of all types of male and female portions that may be used in conjunction with the present invention. Any variation of male and female unions that are know in the art may be applied to the present invention. What is important is that the male and female features that are used are capable of realigning the sensor assembly automatically or upon manual manipulation following jarring, movement or de-alignment.

Figure 7A:
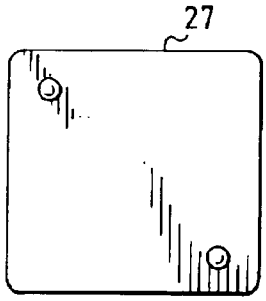
FIGS. 7A–7F are views of exemplary male and female portions useful in self-aligning sensor assemblies of this invention.
Figure 7A:
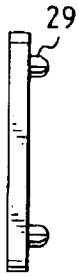
Figure 7B:
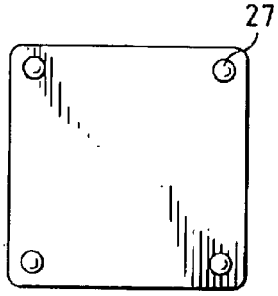
Figure 7B:
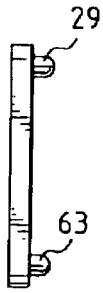
Figure 7C:
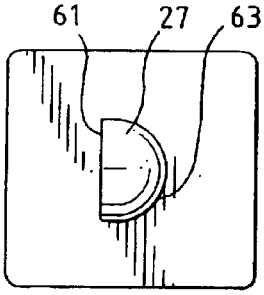
Figure 7C:
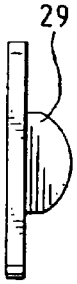
Figure 7D:
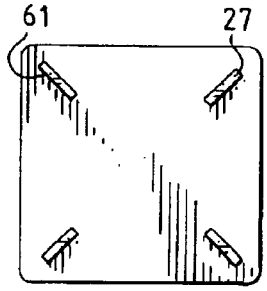
Figure 7D:
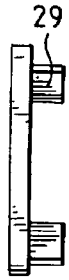
Figure 7E:
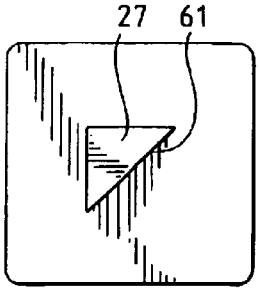
Figure 7E:
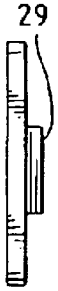
Figure 7F:
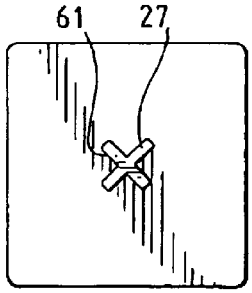
Figure 7F:
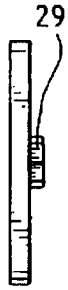

A preferred feature that ensures reproducible unification of the male portion with the female portion is a linear portion 61 as shown in FIGS. 7C–7F. Linear portion 61 forces the male and female portions to be reunited in one or more defined positions thereby allowing the sensor assembly to reproducibly realigned. As shown in FIGS. 7A, 7B and 7C, the male and female portions may include an arched or rounded portion 63, they may include only linear portions 61 as shown in FIG. 7D, or they may include combinations of both. Alternatively, there may be a plurality of male and female portions as shown in FIGS. 7A–7B. FIG. 7B shows four male and female portions in the form of circular nibs which are complimentary to apertures in the female portion. Using 2 or 3 or 4 or more such nibs in apertures allows for precise realignment of the sensor brackets.

In a preferred embodiment, the sensor assembly of this invention is used in conjunction with garage door infrared reversing sensors. Garage door sensors are always active. When the sensors detect an interruption in sensor signal, the sensors automatically halt the garage door from closing and reverse the garage door movement and cause it to open.

Figure 10:
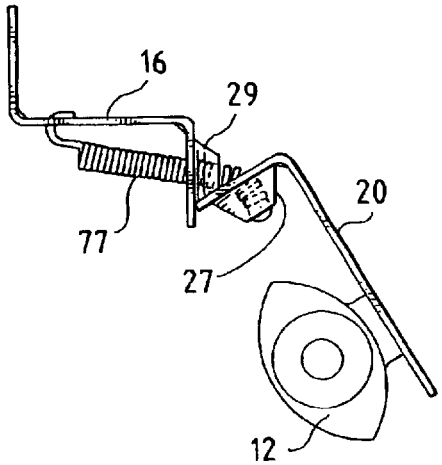
FIG. 10 is a front view of the self-aligning sensor assembly of FIG. 9 when it is out of alignment.

Another aspect of this invention is a method for using a garage door sensor assembly of this invention to deactivate a garage door for a period of time while the garage door is open. The deactivation is accomplished by first opening the garage door as normal. Next, the user grasps the sensor bracket and rotates the sensor bracket with respect to the stationary bracket until the sending or receiving sensor is out of alignment with the opposing sensor. Such an out of alignment sensor is shown in FIG. 10. In a preferred embodiment of the invention, the male and female portions of the brackets are as shown in FIGS. 7B or 7D or 7F or 6A–6C, and the misalignment is achieved by rotating the sensor bracket 90° with respect to the stationary bracket until the male and female portions become complimentary to one another with the sensor in an out of alignment position. In the 90° out of phase position, the garage door sensors are out of alignment and the garage door cannot be closed even upon activation of the garage door transmitter or button without continuously depressing the transmitter button. This prevents children for example from inadvertently closing a garage door while an adult is outside.

The garage door lockout is reversed by grasping the sensor bracket and rotating it with respect to the stationary bracket until the male and female portions are united in a position that aligns the emitter and detector sensors.

Whereas the invention has been described with reference to several embodiments, it will be understood the invention is not limited to those embodiments. The invention is intended to encompass all modifications, alternatives, and equivalents as may be included within the spirit and scope of the invention as defined by the appended claims.

We claim:

1. A self-aligning sensor assembly comprising:

a. a first bracket including a female portion;

b. a second bracket including a male portion that is complementary to the first bracket female portion;

c. a flexible assembly attached to the first bracket and attached to the second bracket; and d. a sensor attached to a bracket selected from the first bracket or the second bracket wherein the sensor is a garage door opener sensor.

2. The self-aligning sensor assembly of claim 1 wherein the first bracket is a stationary bracket and the second bracket is a sensor bracket and the sensor is attached to the second sensor bracket.

3. The self-aligning sensor assembly of claim 1 wherein the first bracket is a sensor bracket and the second bracket is a stationary bracket and the sensor is attached to the first sensor bracket.

4. The self-aligning sensor assembly of claim 1 wherein the flexible assembly is attached to a portion selected from the female portion of the first bracket or the male portion of the second bracket.

5. The self-aligning sensor assembly of claim 1 wherein the flexible assembly includes a flexible link selected from the group consisting of an adhesive cord, a spring, and combinations thereof.

6. The self-aligning sensor assembly of claim 5 wherein the flexible link is a spring having a first hooked end and a second hooked end.

7. The self-aligning sensor assembly of claim 5 wherein the flexible link is a bungee cord.

8. The self-aligning sensor assembly of claim 1 wherein the male and female portions have at least one straight wall.

9. The self-aligning sensor assembly of claim 8 wherein the male portions and female portion are both shaped like a truncated pyramid.

10. A self-aligning sensor assembly useful in conjunction with an electric garage door opener sensor comprising:

a. a first bracket including a female portion in the shape of a truncated pyramid;

b. a second bracket including a male portion that is complementary to the first bracket female portion;

c. a flexible assembly attached to the first bracket and attached to the second bracket wherein the flexible assembly includes a flexible link; and d. an electric garage door opener sensor attached to a bracket selected from the first bracket or the second bracket.

11. The self-aligning sensor assembly of claim 11 wherein the first bracket is a stationary bracket, the second bracket is a sensor bracket and the garage door opener is attached to the second sensor bracket.

12. The self-aligning sensor assembly of claim 11 wherein the first bracket is a sensor bracket, the second bracket is a stationary bracket, and the sensor is attached to the first sensor bracket.

13. The self-aligning sensor assembly of claim 10 wherein the flexible link is a spring having a first hooked end that is attached to the first bracket male portion, and a second hooked end that is attached to the second bracket female portion.

14. The self-aligning sensor assembly of claim 10 wherein the flexible link is a bungee cord.

15. A self-aligning sensor assembly comprising:

a. a spring including a first end that is attached to a base and a second end;

b. a sensor bracket that is attached to the spring second end; and c. a sensor attached to a sensor bracket wherein the sensor is an electric garage door opener sensor.

16. The self aligning sensor assembly of claim 15 wherein the base is selected from the group consisting of a garage door wall and a garage door rail.

17. A method for deactivating a garage door opener using a self-aligning sensor assembly including a stationary first bracket including a portion selected from a male portion and a female portion, a second bracket including a portion selected from a male portion or a female portion wherein the first bracket and the second bracket do not both include male portions or female portions and wherein the female portion is complementary to the male portion, a flexible assembly attached to the first bracket and attached to the second bracket for uniting the first bracket with the second bracket under tension, and a first sensor attached to the second bracket and aligned with a second electric garage door opener sensor comprising the steps of:

a. grasping the second bracket and pulling the second bracket laterally away from the stationary first bracket until the male and female portions disengage; and b. rotating the second bracket in a first direction until the sending sensor and the receiving to go out of alignment.

18. The method of claim 17 wherein the male and female portions re-engaged with the first sensor and the second sensor out of alignment.

19. The method of claim 17 wherein the first sensor and the second sensor are realigned by rotating the second bracket in the reverse of the first direction until the male portion and the female portion are aligned, allowing the flexible assembly to draw the second bracket laterally towards the first bracket and releasing the second bracket when the first and the second bracket abut one another.

* * * * *